US006360521B1

(12) United States Patent
Kägi

(10) Patent No.: US 6,360,521 B1
(45) Date of Patent: Mar. 26, 2002

(54) RING FOR RING FRAMES AND RING TWISTERS

(75) Inventor: Jörg Kägi, Gibswil (CH)

(73) Assignee: Bracker AG (CH)

( * ) Notice: Subject to any disclaimer, the term of this patent is extended or adjusted under 35 U.S.C. 154(b) by 0 days.

(21) Appl. No.: 09/647,333

(22) PCT Filed: Apr. 2, 1998

(86) PCT No.: PCT/CH98/00124

§ 371 Date: Nov. 17, 2000

§ 102(e) Date: Nov. 17, 2000

(87) PCT Pub. No.: WO99/51802

PCT Pub. Date: Oct. 14, 1999

(30) Foreign Application Priority Data

Feb. 4, 1998 (CH) ..... PCT/CH98/00124

(51) Int. Cl.[7] ..... D01H 7/60
(52) U.S. Cl. ..... 57/137; 57/119; 57/125
(58) Field of Search ..... 57/119, 124, 125, 57/136, 126, 137

(56) References Cited

U.S. PATENT DOCUMENTS 2,970,425 A 2/1961 Foard
4,246,746 A * 1/1981 Rumsey et al. ..... 57/75
4,354,342 A * 10/1982 Rumsey et al. ..... 57/119
4,362,012 A * 12/1982 Chatelier ..... 57/355
4,677,817 A * 7/1987 Kanai ..... 57/125
4,885,905 A 12/1989 Maruta et al.
5,584,168 A * 12/1996 Artzt et al. ..... 57/119
5,721,055 A * 2/1998 Feldstein ..... 428/457
5,829,240 A 11/1998 Benson et al.

FOREIGN PATENT DOCUMENTS

DE 843 490 7/1952
DE 43 00 491 A1 7/1994

OTHER PUBLICATIONS

Industrie Anzeiger; "Stukturierte Hartchromschichten"; Sonderdruck Ausgabe Published Aug., 1995.
Schatt: Werkstoffe des Maschinen–, Anlagen– & Apparatebaus; "Materials and mechanical engineering, plant construction and apparatus engineering"; VEB Deutscher Verlag für Grundstoffindustrie; Leipzig; 1982; p. 144.

* cited by examiner

*Primary Examiner*—Danny Worrell
(74) *Attorney, Agent, or Firm*—Adams, Schwartz & Evans, P.A.

(57) ABSTRACT

A ring for a ring spinning or a ring twisting machine, comprising an annular polished core and a hard chrome layer, wherein the core is coated with a copper layer, and wherein the hard chrome layer is applied to the copper layer.

17 Claims, 1 Drawing Sheet

RING FOR RING FRAMES AND RING TWISTERS

TECHNICAL FIELD AND BACKGROUND OF THE INVENTION

The invention relates to a ring for ring spinning and ring twisting machines.

A ring for a ring spinning or ring twisting machine must not only have a precision-machined shape, but also an optimized surface adapted to the requirements, in order to allow a ring traveler rotating on the ring at speeds of up to 55 m/s to run smoothly and with as little wear as possible. For this purpose, the surface of the ring must be as smooth and as hard as possible and should oppose only slight running resistance to the ring traveler. The ring should have low wear, since, with increasing wear of the ring, the smooth running of the ring traveler on the ring is also impaired, and this may lead to increased thread breaks. Moreover, with increasing wear defects of the ring, the wear of the ring traveler also increases, thus leading to shorter service lives of the ring traveler and ring, and this, in turn, and also the increased thread breaks, raise the production costs.

U.S. Pat. No. 2,970,425 discloses rings for ring spinning and ring twisting machines, having a polished core which is electrolytically coated with nickel, chrome or other conventionally obtainable metals, this coating, in turn, being polished.

SUMMARY OF THE INVENTION

The object of the present invention is, therefore, to provide a ring for ring spinning and ring, twisting machines, which allows a more economical use of rings and rings travelers.

This object is achieved by means of a ring which has the feature of claim 1.

By means of a hard chrome layer, the ring acquires very hard wear-resistant surface which is applied preferably directly to a core of the ring, the ring acquires a very hard wear-resistant surface which adheres firmly to the core of the ring. Hardness values of the hard chrome layer, as measured according to Vickers HV 0.05, of 900 to 1300, preferably with values of more than 1000, are advantageous. Surprisingly, the hard chrome layer can be used without difficulty as a coating for the ring, even though very high temperatures {up to about 1000° C.) may occur during the rapid rotation of the ring travelers on the ring. A person skilled in the art knows (cf. Schatt: "Werkstoffe des Maschinen-, Anlagen- und Apparatebaues" ["Materials in mechanical engineering, plant construction and apparatus engineering"], VEB Deutscher Verlag fur Grundstoffindustrie, Leipzig 1982, page 144) that hard chrome layers soften at temperatures above 400° C., which is why the use of hard chrome coatings has never been considered hitherto for rings. The core of the ring has a core surface which has been polished before the application of the hard chrome layer. The core is coated with a copper or nickel layer which is then, in turn, polished and on which the hard chrome layer is arranged. Particularly advantageously, such nickel or copper layers are on the core and under the hard chrome layer under corrosive conditions of use of the ring. A hard chrome layer applied to a polished core surface has a very smooth surface, thus giving rise to a very smooth run of a ring traveler on the ring hard-chrome plated in this way. Commissioning, without the ring being run in, is therefore possible without any problems, thus greatly reducing the production loss due to running-in times.

Rings having a core with a nickel or copper layer which is arranged under the hard chrome layer have particularly suitable for use under extreme conditions, such as, for example, wet spinning.

A ring, of which the hard chrome layer applied to the core of the ring likewise has a polished surface, affords special advantages, since, due to the polishing of the surface of the hard chrome layer, sharp-edged points of chrome crystals which may project from the surface of the hard chrome layer are rounded. These pointed sharp-edged crystals of the hard chrome layer act in the manner of a tile and lead to pronounced wear in objects sliding or slipping over the hard chrome layer. These file-like properties of the hard chrome layers known hitherto are another reason why hard chrome layers have never been considered hitherto for rings for ring spinning or ring twisting machines. However, if the hard crystal points of the hard chrome layer are rounded by polishing, this problem is eliminated. The ring still opposes only slight running resistance to the ring traveler rotating on it and there is no increased wear on the ring traveler. If, therefore, the core surface and the surface of the hard chrome layer are polished, a very smooth, hard and wear-resistant ring surface is obtained, on which the ring traveler can rotate with only slight wear. At the same time, before the hard chrome layer is applied, the roughness of the core 10 surface amounts, for example, to Ra 0–0.3 pm, preferably below 0.2 pm. At an Ra value of the core surface of, for example, 0.15 pm, the surface of the hard chrome layer applied to it also has a roughness of approximately 0.15 pm.

When structured hard chrome layers (so-called Topocrom layers) and/or chrome dispersion layers, which are enriched with nonmetallic components (ECD layers) are used, the properties of the hard chrome layer can be varied and can be adapted exactly to the respective requirements.

It is likewise advantageous if the core of the ring is composed of heat-treated steel. The high speeds at which the ring travelers rotate on the rings may give rise to high centrifugal forces, so that the ring travelers load the ring with corresponding pressure forces. Thread breaks at these rotational speeds may lead to a sudden impact load on the ring by the ring traveler. Too soft a basic material of the core leads to damage to the core and to the hard chrome layer in the event of such pressure or impact loads. By contrast, if the basic material of the ring is a heat-treated steel, the material lying under the hard chrome layer does not yield, even under high pressure load and sudden impact load, and the ring can survive these loads, even without the hard chrome layer and the core lying under it being damaged. This is possible because coating with the hard chrome layer takes place at temperatures of below 100° C. and, as a result, the properties, such as, for example, the hardness, of the basic material are no longer modified, for example, by recrystallization or heat diffusion processes. The service life of the ring is increased, and, even after an event, such as, for example, a thread break, it continues to be possible for the ring traveler to run smoothly, with low wear, on the ring. Heat-treated rolling-bearing steel has proved particularly suitable for use as the core of a ring.

The hard chrome layer advantageously has a thickness of between 1 pm and 60 pm, in a preferred embodiment the layer thickness being greatest in the region of the highest stress, that is to say in those regions of the ring which come into contact with the ring traveler while it is running on the ring.

A ring having the hard chrome layer only in the regions which form contact surfaces between ring and ring traveler when the ring traveler is running on the ring leads, in the same way as a ring coated completely with a hard chrome layer, to better running properties of the ring traveler on the ring and therefore to longer service lives, to fewer thread breaks and also to lower wear on the ring itself, as a result of which, by means of such a ring, a more economical use of the ring and ring traveler is also possible.

The ring has at least one electrocontact location, via which the ring is supplied with current during the application of the hard chrome layer. This electrocontact location is advantageously situated in the region of a seat which is located opposite the region, for example, a flange, having the contact surfaces. This arrangement ensures that no undesirable unevennesses, roughnesses or other disturbances occur in the region of the contact surfaces due to the electrocontact locations in the hard chrome layer or on the surface of the ring. Even when the position of the electrocontact locations can no longer be located by the naked eye after the polishing of the hard chrome layer, the hard chrome layer may nevertheless have in these places microdisturbances which have an adverse effect on the wearing resistance or running of the ring traveler or the wearing resistance of the ring.

A hard-chrome plated ring according to the invention may advantageously be used in all spinning mills and twisting mills which operate with ring spinning and ring twisting machines respectively, since the production costs can be lowered, using such a ring. The ring affords special advantages wherever materials are processed which, during processing, discharge lubricating substances, such as, for example, animal fat or fibers with lubricating properties, in the region of the ring and of the ring traveler. The ring is very particularly suitable for the processing of cotton with its short fibers which have a lubricating action. Since the surface of the ring has very high wear resistance and opposes only slight running resistance to the ring traveler, so that the latter runs with very low wear on such a ring, there is no need for any additional lubrication, such as, for example, with molybdenum disulfide lubricant, in order to ensure long service lives and continuous operation with few thread breaks. The ring is highly suitable even for extreme conditions such as occur during wet spinning. Good corrosion resistance, as is particularly important under these conditions, is achieved by means of a ring traveler, the hard chrome layer of which has, for example, a nickel-plated undercoat or copper-plated undercoat. Further preferred embodiments and uses are a subject matter of further dependent claims.

BRIEF DESCRIPTION OF THE DRAWINGS

The invention is explained below by way of example with reference to the purely diagrammatic FIGS. 1 to 3 of which.

DESCRIPTION OF THE PREFERRED EMBODIMENTS AND BEST MODE

Figure 1:
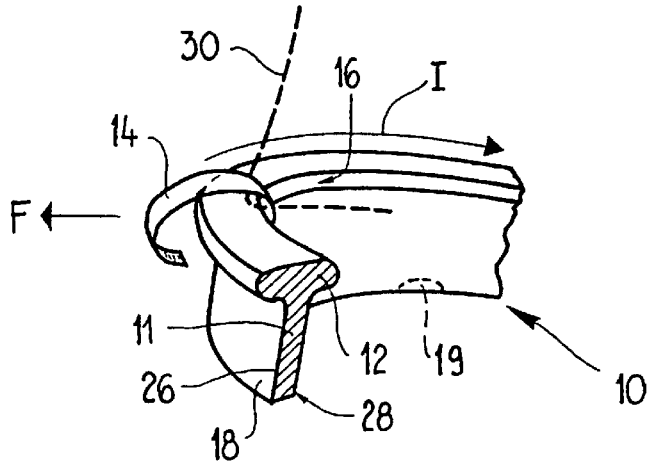
FIG. 1 shows part of a ring with a T-flange and with a ring traveler rotating on it.

FIG. 1 shows in perspective part of a ring 10 coated (not explicitly illustrated) with a hard chrome layer 26 and having a core 11 which is produced, for example, from heat-treated rolling-bearing steel and one side of which is in the form of a T-flange 12. The side located opposite the flange 12 is designed as a seat 18 which may be configured in a wide variety of ways, for example also as illustrated in FIG. 2*c*. The annular core 11 of the ring 10 has a polished core surface 28.

Situated in the region of the seat 18 is an electrocontact location 19 (indicated by broken lines in FIG. 1), via which the ring is supplied with current during the electrochemical application of the hard chrome layer. Before the cathodic deposition of the chrome on the ring 10, the core 11 of the ring 10, said core having a core surface 28, is coated with a nickel or copper layer (29).

A matching C-shaped ring traveler 14 runs in the direction of the arrow I on the T-flange 12 of the hard-chrome plated ring 10 shown in FIG. 1. As a result of the centrifugal force (arrow F) acting on the ring traveler 14 during rotation, said ring traveler 14 is forced outward on the ring 10 in a direction radial with respect to said ring 10. A flank, which cannot be seen, of the C-shaped ring traveler 14 hangs on the radially inner side 16 of the flange 12 of the ring 10 and thus holds the ring traveler 14 on the ring 10.

Figure 2A:
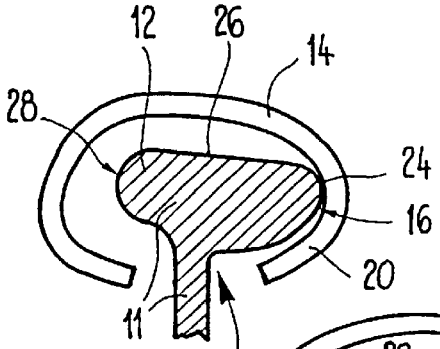
FIGS. 2*a* to 2*c* show rings with different flange profiles in cross section, in each case with matching ring travelers.
Figure 2B:
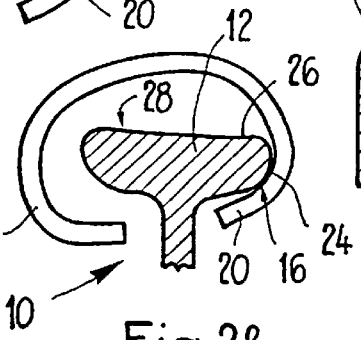
Figure 2C:
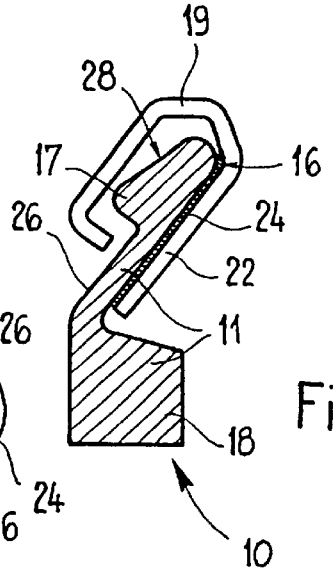

FIGS. 2*a* and 2*b* illustrate, each in section, two embodiments of hard-chrome plated rings 10 with T-flanges 12 and with matching, likewise somewhat differently configured C-shaped ring travelers 14. By contrast, FIG. 2*c* illustrates a section through a hard-chrome plated ring 10, the core 11 of which is in the form of an oblique flange 17. Arranged opposite the oblique flange 17, and likewise shaped out of the core 11, is a seat 18 which, in this example, has a square cross section. Shown on the oblique flange 17 is a matching hook-shaped ring traveler 19. All the ring travelers 14, 19 are illustrated in a position relative to the respective flange 12, 17 which they assume with respect to the ring 10 during operation. A flank 20, 22 of the ring travelers 14, 19, said flank in each case lying radially on the inside with respect to the ring 10, bears on the radially inner side 16, 16' of the respective flange 12, 17, so that a contact surface 24 is formed between the ring traveler 14, 19 and the flange 12, 17 of the respective ring 10. The stress on the ring 10 in terms of wear, temperature, pressure, etc. is greatest in the region of this contact surface 24. In order to counter this load correspondingly, a hard chrome layer 26 is thickest in this region of the ring 10.

Figure 3A:
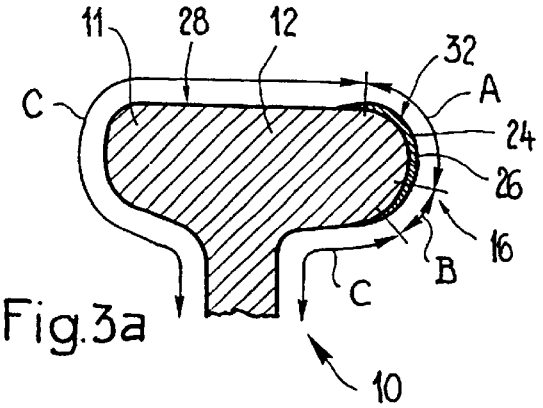
FIG. 3*a* shows the ring from FIG. 2*a* with only partially coated core surface.
Figure 3B:
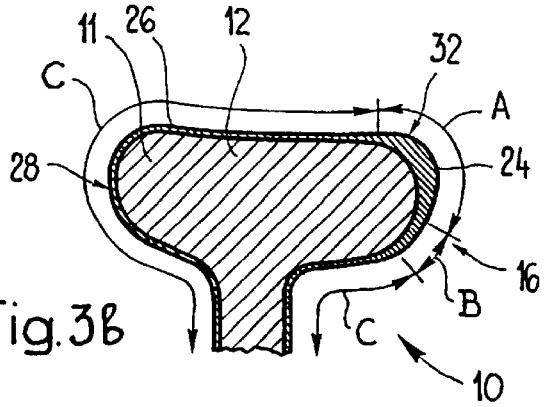
FIG. 3*b* shows the ring from FIG. 2*a* with a completely coated core and a suggested layer thickness distribution of the hard chrome layer on this core.

FIGS. 3*a* and 3*b* illustrate the ring from FIG. 2*a* again in section. The hard chrome layer 26 covers only part of the core surface 28 in FIG. 3*a*, whereas the ring 10 shown in FIG. 3*b* is covered completely with the hard chrome layer 26. The hard chrome layer 26 is applied directly to the polished core surface 28 of the core 11 of the respective ring 10. Since a thread 30, which is led through (as indicated in FIG. 1 by broken lines) the ring traveler 14, 19 during operation, is under varying tension, depending on speed, type of thread and machine settings, that region of the ring 10 or its flange 12, 17 which forms the contact surface 24 with the ring traveler 14, 19 may vary locally. A region A on the radially inner side 16 of the flange 12 of the ring 10, on which region the contact surface 24 may be formed 10 during operation, is therefore selected somewhat larger than the contact surface 24 which is actually formed at this location.

Since this region A, in which the contact surface 24 will be formed during operation, is exposed to the highest loads, the hard chrome layer 26 is applied either more or less in this region A only (cf. FIG. 3*a*) or at its thickest in this region A (cf. FIG. 3*b*).

FIG. 3*a* shows an exemplary embodiment, in which the hard chrome layer 26 is applied mainly in the region A and also a little in a transitional region B which may also be subjected to load (see further below. The remaining region C of the ring 10 is not coated with the hard chrome layer 26. A ring 10 of this type has the same advantages in terms of low wear of the ring 10 and ring traveler 14, 19, high running smoothness, few thread breaks, etc. as a fully chrome-plated ring 10.

In the completely coated exemplary embodiment shown in FIG. 3D, the thickness of the hard chrome layer 26 is, for example, 20–40 pm in the region A. In a transitional region B on the radially inner side 16 of the flange 12, the hard chrome layer 26 has the medium thickness of 10 to 25 pm. The layer thickness in the remaining region C making up the rest of the ring 10 is around at least 4 pm. The reason for the medium layer thickness of the hard chrome layer 26 in the transitional region B of the ring 10 is that, during operation, in the case of an unfavorable parameter setting (type of thread, thread thickness, ring traveler shape, ring traveler weight, etc.), a contact surface 24 between the ring traveler 14, 19 and ring 10 may be formed even in this transitional region B. So that the ring 10, after being operated once with such an unsuitable parameter setting, is not damaged immediately and can continue to be used without any problem, it is expedient for the ring 10 to have a somewhat thicker hard chrome layer 26 in this region than in the remaining region C.

In order to ensure smooth and, above all, low-wear running of the ring traveler 14, 19 on the ring 10, the surface 32 of the hard chrome layer 26 is polished, for example, to Ra 0.2 pm, at least in the region A, in both examples.

So that the core 11 of the ring 10 is just as resistant as the hard chrome layer 26, the core 11 is, for example, a rolling-bearing steel with a heat-treated surface. Impact or pressure loads can thus be absorbed by the ring 10, without the hard chrome layer 26 being damaged due to the yielding of a core 11 of relatively "soft" material. However, other materials may of course, also be envisaged as basic material for the core 11, such as, for example, other case hardened, heat-treated and even non-heat-treated steels, ceramics, plastics or, for example, composite materials which have comparable properties, for example hardness, impact resistance, etc., to those of a heat-treated rolling-bearing steel. For better corrosion resistance, the core may be coated with a nickel or copper layer. The hard chrome layer itself may also be an ECD or Topocrom layer.

As the different shapes of the rings 10 shown in FIGS. 2*a* to 2*c* are already indicated, all ring shapes are suitable for taking the form of a ring 10 with a hard chrome layer 26. As regards the material and shape of the ring traveler 14, 19, too, there are no restrictions in respect of the capability of using it together with the ring 10 according to the invention.

What is claimed is:

1. A ring for a ring spinning or a ring twisting machine, comprising an annular polished core and a hard chrome layer, wherein the core is coated with a copper layer, and wherein said hard chrome layer is applied to the copper layer.

2. A ring according to claim 1, wherein the hard chrome layer has a polished surface.

3. A ring according to claim 1 or 2, wherein the copper layer has a polished surface.

4. A ring according to claim 3, wherein the hard chrome layer is enriched with non-metallic elements.

5. A ring according to claim 4, wherein the core of the ring comprises steel.

6. A ring according to claim 5, wherein the hard chrome layer is between 1 $\mu$m and 60 $\mu$m thick and has a hardness HV of between 900 and 1200 and a roughness Ra of up to 0.3 $\mu$m.

7. A ring according to claim 6, and including a raised contact surface defined by a portion of said hard chrome layer and adapted for sliding engagement with a ring traveler rotating around the ring.

8. A ring according to claim 7 and including an electro-contact location formed on a seat disposed on a side of the ring opposite said contact surface.

9. A ring according to claim 4, wherein the core comprises heat-treated steel.

10. A ring according to claim 8, wherein a side of the ring located opposite the seat comprises a flange.

11. A ring for a ring spinning or ring twisting machine, comprising an annular polished core and a hard chrome layer, wherein the core is coated with a nickel layer, and wherein the hard chrome layer is applied to the nickel layer.

12. A ring according to claim 11, wherein the hard chrome layer has a polished surface.

13. A method of forming a ring having increased wear resistance and adapted for cooperating with a complementary ring traveler for processing fibrous materials on a ring spinning machine, comprising the steps of:

(a) forming an annularly shaped ring comprising a core having a polished surface;

(b) coating said polished surface of said core with a copper layer; and (c) applying a hard chrome layer to said copper layer, thereby enhancing the wear resistance of said ring.

14. A method of forming a ring having increased wear resistance and adapted for cooperating with a complementary ring traveler for processing fibrous materials on a ring twisting machine, comprising the steps of:

(a) forming an annularly shaped ring comprising a core having a polished surface;

(b) coating said polished surface of said core with a copper layer; and (c) applying a hard chrome layer to said copper layer, thereby enhancing the wear resistance of said ring.

15. A method of forming a ring according to claim 13 or 14, and including the step of polishing said hard chrome layer, thereby creating a smooth surface having enhanced wear characteristics and adapted for complementary, sliding engagement with the ring traveler.

16. A method of forming a ring according to claim 13, wherein said ring is adapted for use on a ring spinning machine in a spinning mill.

17. A method of forming a ring according to claim 12, wherein said ring is adapted for use on a ring twisting machine in a twisting mill.

* * * * *